US006974382B1

(12) United States Patent
Swan

(10) Patent No.: US 6,974,382 B1
(45) Date of Patent: Dec. 13, 2005

(54) YEAR ROUND SELECTIVE DEHUMIDIFYING AND HUMIDIFYING APPARATUS AND METHOD

(76) Inventor: Ross M. Swan, RR#1, Foxboro, Ontario (CA) K0K 2B0

( * ) Notice: Subject to any disclaimer, the term of this patent is extended or adjusted under 35 U.S.C. 154(b) by 84 days.

(21) Appl. No.: 10/072,070

(22) Filed: Feb. 8, 2002

Related U.S. Application Data

(60) Provisional application No. 60/267,495, filed on Feb. 8, 2001.

(51) Int. Cl.[7] ..... F24F 6/00
(52) U.S. Cl. ..... 454/233; 454/232; 236/44 A
(58) Field of Search ..... 236/44 R, 44 A; 454/236, 233, 232, 234; 137/872

(56) References Cited

U.S. PATENT DOCUMENTS 1,921,900 A * 8/1933 Wood ..... 454/234
3,827,342 A * 8/1974 Hughes
4,147,299 A * 4/1979 Freeman ..... 236/49.3
4,526,318 A * 7/1985 Fleming et al. ..... 236/49.3
RE35,153 E * 2/1996 Chiu ..... 261/26
6,021,953 A * 2/2000 Swan ..... 236/44 A

* cited by examiner

*Primary Examiner*—Harry B. Tanner
(74) *Attorney, Agent, or Firm*—Hodgson Russ LLP

(57) ABSTRACT

Apparatus which may be used year-round for dehumidifying air in the enclosed space of a building to comfortably allow a higher temperature during summer conditions, for exchanging air in the enclosed space year-round with fresh air to provide a more healthful environment within the building and for selectively humidifying the air when desired at certain times of the year. The apparatus includes a fan mounted on or otherwise adjacent the basement floor or other bottom floor and a conduit connecting the fan outlet to an opening in an outside wall for removing stale relatively damp air from the bottom floor level and discharging it out of the building. A humidifier is provided in flow communication with the fan and connected through another conduit to the enclosed space. A valve connected to both conduits provides selective humidifying of the air in the enclosed space.

5 Claims, 2 Drawing Sheets

YEAR ROUND SELECTIVE DEHUMIDIFYING AND HUMIDIFYING APPARATUS AND METHOD

CROSS REFERENCE TO A RELATED APPLICATION

Applicant claims priority based on U.S. Provisional Application No. 60/267,495 filed Feb. 8, 2001 and entitled "Year-Round Selective Dehumidifying And Humidifying Apparatus And Method", which is incorporated herein by reference.

BACKGROUND OF THE INVENTION

The present invention relates generally to the conditioning of air within a building. More particularly, the present invention relates to the extraction of air from a building for the purpose of dehumidifying the air combined with the selective capability of also humidifying the air when desired at certain times of the year.

It is considered desirable for health reasons to exchange the air in enclosed spaces of various buildings such as warehouses, hair salons, chicken houses, and factories so as to eliminate dust and various noxious substances which may evolve into the enclosed spaces. Newer homes typically are sealed so that noxious gases may not naturally be evolved to the outside. It is thus considered desirable to be able to exchange the air in newer homes as well as in other buildings year-round, i.e., while being heated in winter as well as while being cooled in summer.

The degree of comfort in a building being cooled is related to the degree of humidity. Typically, a thermostat may be set at 72° during the summer for cooling. If the relative humidity in a building could be reduced from perhaps about 75% to perhaps about 45%, the thermostat setting may be raised to cool to perhaps only about 75° F., while maintaining the same comfort level. This would save substantial energy cost and thus substantially reduce the electric bill for the homeowner or building user.

During heating of a building, it is considered desirable to humidify the enclosed space to achieve the desired comfort. However, it still is considered desirable to exchange the air in the enclosed space being heated to remove dust, noxious substances and the like, especially in newer homes, factories and the like.

SUMMARY OF THE INVENTION

It is accordingly an object of this invention to provide exchange of air in the enclosed space of a building year-round while providing dehumidification while the enclosed space is being cooled and humidification selectively if desired while the enclosed space is being heated.

In order to provide for air exchange in an enclosed space of a building year-round as well as dehumidification while the space is being cooled and selective humidification if desired while the space is being heated, in accordance with the present invention, a fan is mounted on or otherwise provided adjacent the bottom floor such as a basement floor of the building to remove air from the bottom floor level. The air is discharged through a conduit the outlet of which is connected to an opening in an outside wall. Vents may be provided in upper floors for routing relatively drier upper air toward the bottom floor to replace relatively damper air being removed. A fresh air intake valve may be provided in an opening in an outside wall, preferably near the top of the enclosed space, to replace the relatively humid air being discharged. A humidifying unit is incorporated in the apparatus adjacent the fan, preferably between the fan and bottom level floor, for selectively humidifying the enclosed space if desired during the time when the enclosed space is being heated.

The above and other objects, features, and advantages of the present invention may be found in the following detailed description of the preferred embodiment thereof when read in conjunction with the appended drawings wherein the same reference numerals denote the same or similar parts throughout the views.

The following detailed description of the invention, when read in conjunction with the accompanying drawing, is in such full, clear, concise and exact terms as to enable any person skilled in the art to which it pertains, or with which it is most nearly connected, to make and use the invention.

DETAILED DESCRIPTION OF THE INVENTION

Figure 1A:
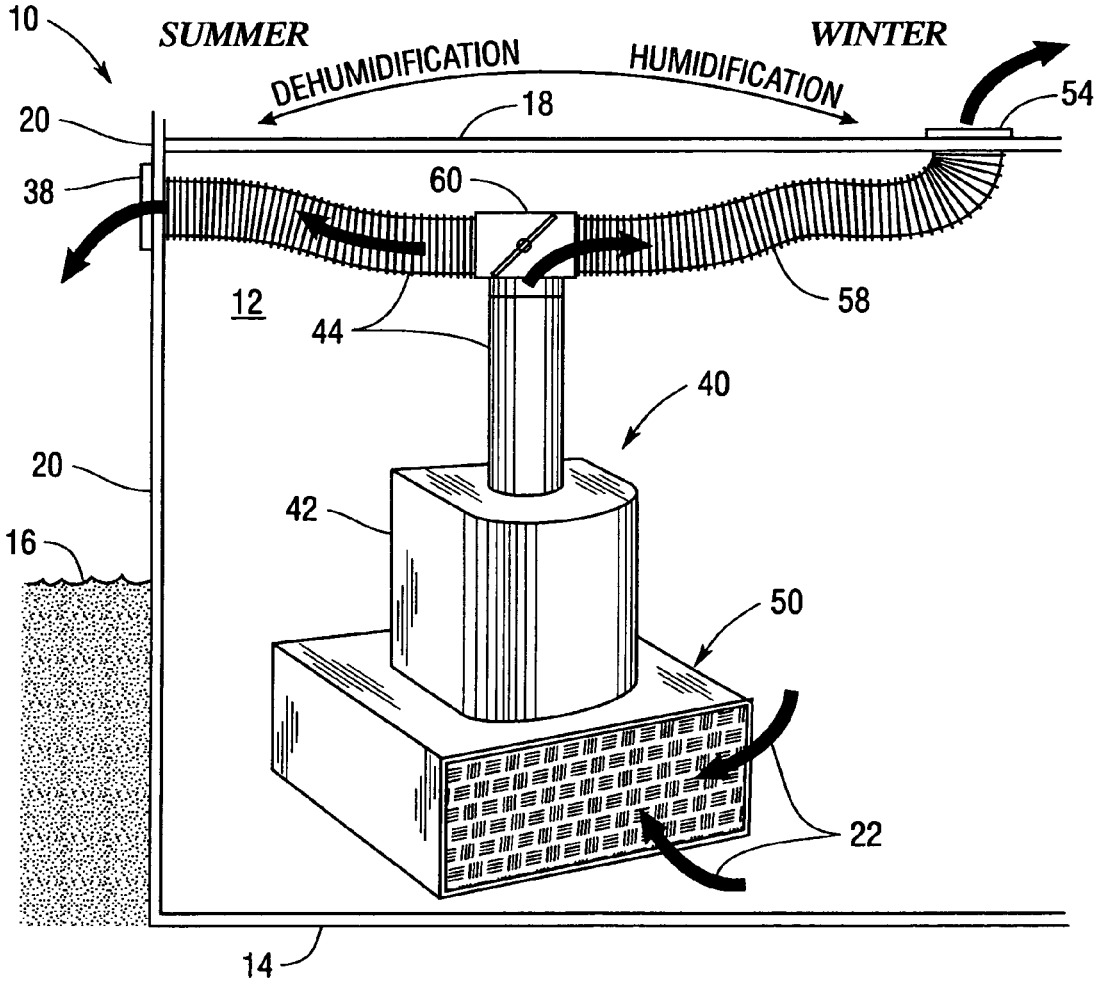
FIG. 1A is a diagrammatic perspective view of the apparatus of the present invention.

Referring to FIG. 1A there is illustrated generally at 10 a building having an enclosed space, illustrated at 12. The building has a bottom floor 14 which typically is a basement floor and which is located below the level of the ground 16. Upper floors may exist, one being shown at 18, and an outside wall is illustrated at 20. As used herein, the term "building" is meant to refer to any structure having enclosed space and which includes, but is not limited to, houses, factories, boats with cabin facilities or the like, warehouses, chicken houses, hair salons, greenhouses, commercial vehicle garages, and nursing homes.

The enclosed space of a building may typically have a humidity gradient with stale damper air being along the basement floor 14 and drier air being near the top of the space. In order to reduce the humidity within the enclosed space on hot days so that the temperature may be kept at a higher level for the desired comfort, the relatively damp stale air at the basement floor level is removed and discharged out of the enclosed space, as illustrated at 38. The drier air in the higher levels of the enclosed space moves downwardly, as illustrated at 22, to replace the discharged damper air.

The dehumidifying apparatus 40 comprises a suitable fan and conduit illustrated at 42 and 44, respectively, which are provided for receiving the stale humid air ad discharging it from the space 12. The conduit may have a diameter of perhaps about six inches. The apparatus 40 is shown and described in detail in U.S. Pat. No. 6,021,953 issued Feb. 8, 2000 and entitled "Year-Round Air Conditioning Apparatus And Method", the disclosure of which is hereby incorporated herein by reference.

If the fan were mounted in the outlet end of the conduit 44, it may be so subjected to the cold outside air on a cold day that it may ice-up, becoming inoperable. In order to allow apparatus 40 to be operated for exchanging air in the enclosed space 12 year-round as well as for dehumidifying the air on hot days, in accordance with the present invention, the fan 42, containing the motor-driven fan blade within the housing, is mounted close to the basement floor 14 or otherwise adjacent the basement floor 14 so that it will be away from cold outside air and instead be in contact with the conduit 44 which is warmed by inside air so that the fan 42 will not ice-up.

Figure 1B:
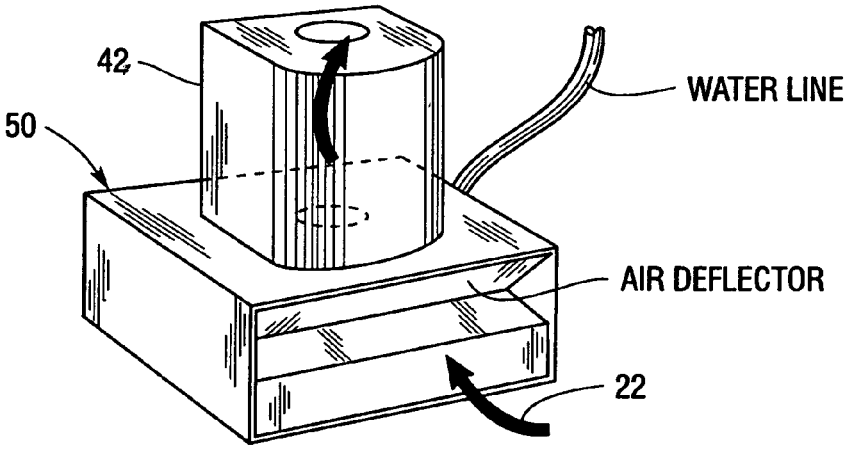
FIG. 1B is a diagrammatic perspective view further illustrating a portion of the apparatus of the FIG. 1A.

In accordance with the present invention, a humidifier 50 is incorporated in the apparatus adjacent the fan 42, preferably between the fan and bottom floor 14 as shown in FIG. 1A, for selectively humidifying the enclosed space 12 if desired during the time when the enclosed space is being heated. When humidifier 50 is operated, conduit 44 can be disconnected from the outdoor exhaust 38 and connected to a grate or register 54 in the floor 18. Preferably, a branch conduit 58 is provided for connection to register 54 and a damper valve 60 controls the flow of air as to either conduit 44 or branch conduit 58. The humidifier 50, also shown by itself in FIG. 1B for purposes of illustration, comprises a tub or water tray equipped with a float valve and a feed line from an existing water pipe in the building together with a suitable housing.

The fan 42 may be operated during both summer and winter conditions (year-round) to remove stale relatively damp air from the basement floor level and discharge it outside the building, this stale relatively damp air being replaced by fresh outside air so that the air in the enclosed space 12 is cleaner and therefore more healthy. During summer conditions, the decrease in relative humidity and the resulting greater personal comfort will allow the enclosed space 12 to be kept at a higher temperature to thereby allow a net savings of air conditioning costs. During winter conditions, the humidifier 50 may be operated to achieve the desired personal comfort while the air removal apparatus 40 may continue to be operated to discharge stale air through opening 38 to maintain cleaner air in the enclosed space 12, resulting in more healthful conditions therein.

The low cost of operation of the air extraction fan 42 allows it to be operated year-round, in a cost effective manner as compared to conventional dehumidifiers which require substantially greater energy costs in condensing moisture in the air but which do not exchange stale air for fresh air. The operation of fan 42 is extended by the humidifier 50 to supply a higher comfort index at minimum cost and actually lower the heating cost. The higher the comfort index, the lower the temperature required.

Figure 2:
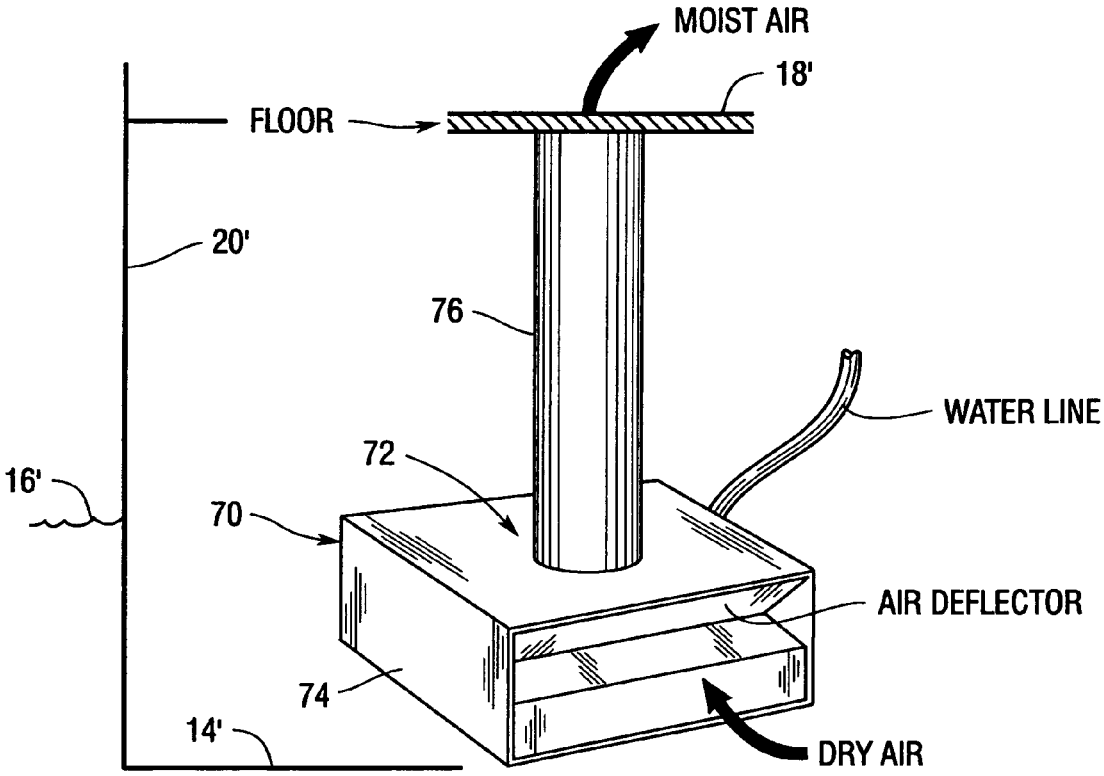
FIG. 2 is a diagrammatic perspective view of another form of humidifier for use in the apparatus of FIG. 1.

FIG. 2 shows an alternative form of humidifier 70 wherein the circulating fan 72 is located adjacent or on the basement or bottom floor 14' of the building. The humidifier 70 also includes water tray, float valve control and water line connection within a housing 74 containing fan 72. A duct 76 provides communication with a register or grate in the upper floor 18'.

It is therefore apparent that the present invention accomplishes its intended objectives. While an embodiment of the present invention has been described in detail, that has been done for the purpose of illustration, not limitation.

What is claimed is:

1. In combination with a building having an enclosed space, a bottom floor, and an outside wall having an opening above ground level, apparatus for conditioning air within the enclosed space, the apparatus comprising first conduit means having an air outlet and connected to said wall opening for discharging air through said wall opening to the exterior of the building and further having an air inlet end, a fan means adjacent the bottom floor and connected to said air inlet end of said first conduit means for removing air from the bottom floor level and discharging the air through said conduit means and the wall opening to the exterior of the building, and the apparatus further comprising a humidifier connected in fluid communication with the air inlet end of said first conduit means, second conduit means having one end open to the enclosed space, and a control valve for connecting the opposite end of said second conduit means to said first conduit means between the air outlet and the air inlet end thereof, there being a single fluid flow path from said bottom floor level through said fan and said humidifier to said control valve, said control valve having a first state allowing fluid flow from the air inlet end of said first conduit means to the air outlet thereof and blocking flow to said second conduit means and having a second state allowing flow from the air inlet end of said first conduit means through said second conduit means and blocking flow to the air outlet of said first conduit means whereby when said control valve is in said first state said apparatus provides dehumidification of air in the enclosed space and when said control valve is in said second state said apparatus provides humidification of air in the enclosed space.

2. A combination according to claim 1, wherein said humidifier is located between said fan means and the bottom floor and said single fluid flow path is defined from the bottom floor level through said humidifier and through said fan means to the air inlet end of said first conduit means.

3. A method for conditioning air within the enclosed space of a building comprising:

a) providing a fan adjacent a bottom floor of the building;
b) providing a first conduit for discharging air from the fan to the exterior of the building;
c) providing a humidifier in flow communication with the fan;
d) providing a second conduit for placing the humidifier in fluid communication with the enclosed space of the building;
e) providing a single fluid flow path from the bottom floor through the fan and humidifier;
f) operating the fan to remove air from the bottom floor level and discharge the air through the first conduit to the exterior of the building;
g) selectively connecting the first conduit to the exterior of the building or the second conduit to the enclosed space; and
h) operating the humidifier when the second conduit is connected to the enclosed space.

4. A method according to claim 3, wherein providing the humidifier in flow communication with the fan includes locating the humidifier between the fan and the bottom floor and providing said single fluid flow path from the bottom floor level through the humidifier and through the fan to the first and second conduits.

5. A method according to claim 3, wherein selectively connecting the first conduit or the second conduit is performed by means of a valve connected to the first and second conduits.

* * * * *